US005331901A

United States Patent [19]

Avery

[11] Patent Number: 5,331,901

[45] Date of Patent: Jul. 26, 1994

[54] STOCK SUPPLY TRAIN HAVING RECIPROCATING TRACTION CHAIN DRIVE

[76] Inventor: Douglas T. Avery, 44 S. Lake Dr., Antioch, Calif. 94509

[21] Appl. No.: 13,621

[22] Filed: Feb. 4, 1993

[51] Int. Cl.[5] ..... B61J 3/08

[52] U.S. Cl. ..... 104/172.1; 198/750; 414/749

[58] Field of Search ..... 104/172.1, 172.3; 198/750; 414/749

[56] References Cited

U.S. PATENT DOCUMENTS

| | | | |
|---|---|---|---|
| 2,700,345 | 1/1955 | Cox | 105/29.1 |
| 3,113,767 | 12/1963 | Halberstadt | 414/749 X |
| 3,207,500 | 9/1965 | Kooy | 104/172.1 X |
| 3,364,873 | 1/1968 | Buckley et al. | 104/172.1 X |
| 3,447,482 | 6/1969 | Jones | 104/172.1 |
| 3,497,089 | 2/1970 | Forster et al. | 104/94 X |
| 4,044,886 | 8/1977 | Sender | 198/750 X |
| 4,235,475 | 11/1980 | Monks | 104/172.1 X |
| 4,254,710 | 3/1981 | Guay | 104/165 |
| 4,308,945 | 1/1982 | Beckmann et al. | 198/750 |
| 4,368,037 | 1/1983 | Limque et al. | 104/93 X |
| 4,473,010 | 9/1984 | Dietz et al. | 104/172.1 |
| 4,690,611 | 9/1987 | Nobuhara | 104/172.1 |
| 5,054,605 | 10/1991 | Bavis | 414/749 X |

FOREIGN PATENT DOCUMENTS

| | | | |
|---|---|---|---|
| 1050357 | 12/1966 | United Kingdom | 198/750 |

*Primary Examiner*—Robert J. Oberleitner
*Assistant Examiner*—S. Joseph Morano
*Attorney, Agent, or Firm*—Bielen, Peterson & Lampe

[57] ABSTRACT

A stock supply train system for on-demand delivery of materials to a work station for selective loading and unloading, the supply train system having a displaceable railway train and a stationary track on which one or more railway cars roll under power of a stationary chain drive. The chain drive has a feed chain with opposite ends connected to respective opposite ends of the railway train, the train system including a stationary control panel at the work station for controlling operation of the chain drive and reciprocal displacement of the railway train on the railway track.

11 Claims, 2 Drawing Sheets

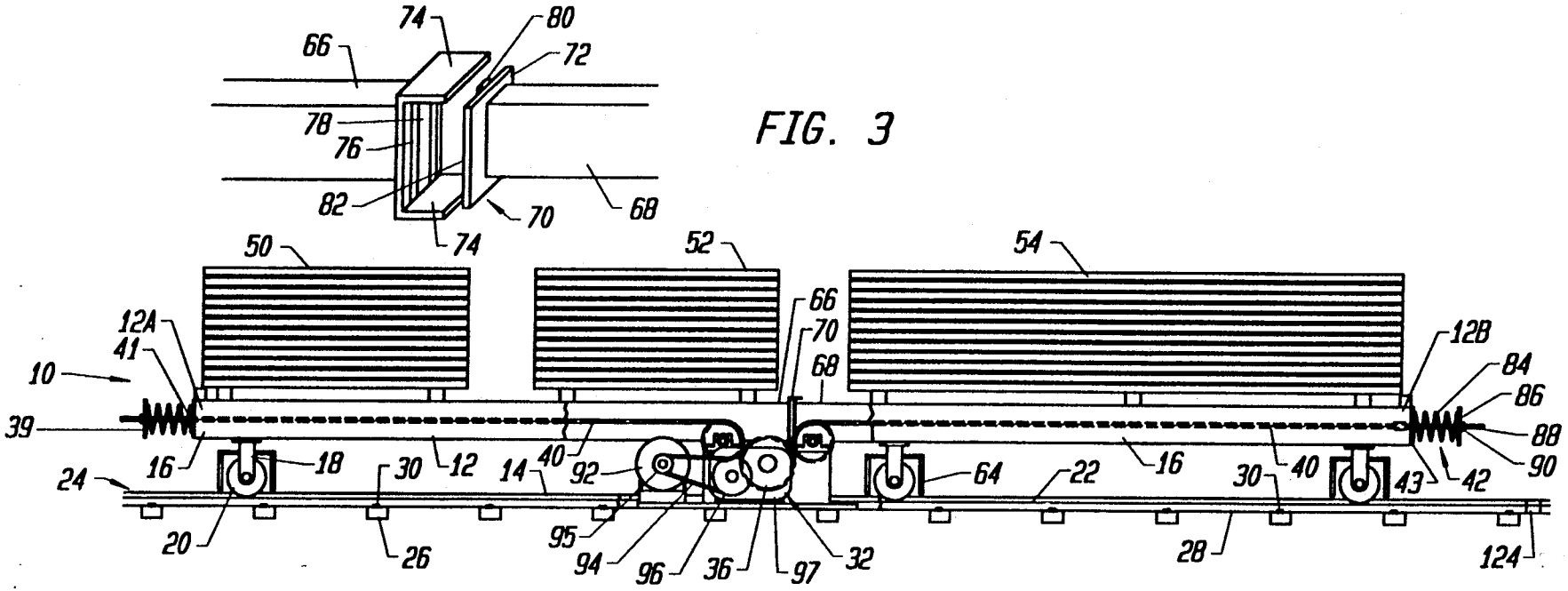
FIG. 3
FIG. 1
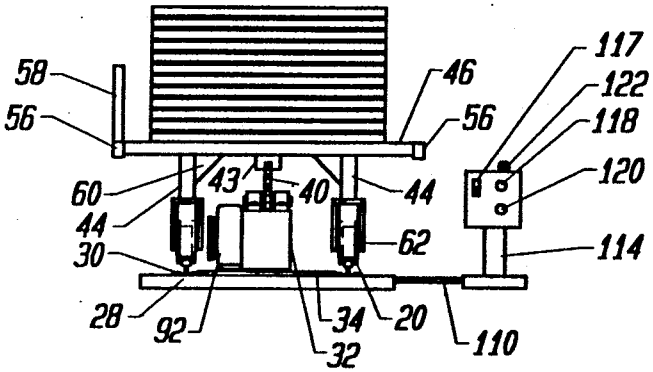
FIG. 2
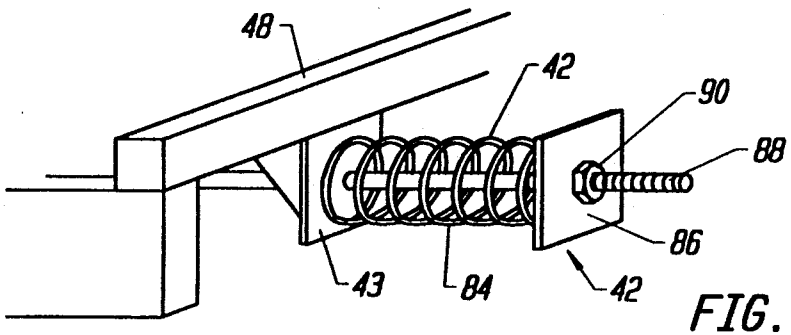
FIG. 5

STOCK SUPPLY TRAIN HAVING RECIPROCATING TRACTION CHAIN DRIVE

BACKGROUND OF THE INVENTION

The stock supply train of this invention is an operator controlled supply system for delivery of materials to a work station and in its preferred application, is used to deliver units of stock lumber to a saw mill for cutting, for example in the manufacture of prefabricated wood trusses.

In many industries, efficient operation of work stations requires timely supply of working stock to the working station. Frequently, equipment at a working station has a high capital value with a slow payback simply because the equipment is not used near to its capacity. In any fabrication operation where heavy materials must be continually supplied to the work station, means must be provided to prevent downtime while more stock is moved to the feed station. Where operations are of a kind that different types or sizes of materials are required, particularly in a random or unscheduled manner, the supply system must be sufficiently flexible to accommodate select supply on operator demand. The particular challenges to maintaining a continuous supply of different sizes or lengths of lumber to a sawyer has resulted in the invention of the subject stock supply train. While the stock supply train has particular application to a saw mill, it will be readily apparent that the stock supply train will have other applications where bulky or heavy materials are required to be delivered to a feed station on operator demand.

The stock supply train of this invention allows a supply of materials to be prepared for one or more full shifts of a work station operator before his shift begins, eliminating the down time otherwise required during restocking.

SUMMARY OF THE INVENTION

The stock supply train of this invention is a system devised to supply materials to a work station, particularly where the materials are bulky or heavy, and ordinarily require the attention of a delivery operator in addition to the work station operator. In the preferred embodiment described in the detailed description, the stock supply train is used in conjunction with a programmable saw mill to supply different lengths of lumber to the feed station of the mill on demand by the sawyer. The operating efficiency of such a mill can be greatly improved, allowing it to be operated at near capacity, by providing a steady supply of the required lumber. In cutting feed stock for factory fabricated trusses, minimization of end cut waste is key to economy. The sawyer must continually shift selection of lumber stock according to approximate lengths required. Even in fix length supply operations, when one unit or bundle is exhausted, the next unit or bundle must be readily at hand for continuous operation of the milling equipment.

The stock supply train of this invention provides a multi-car train operable by the work station attendant that selectively positions each car at the work station by the attendant. The multi-car train rolls on a stationary track in a forward or reverse direction under command of the station operator. A stationary chain drive transports a link chain that interconnects the multiple cars forming the train on the fixed track under guidance of a control system at a control station proximate the operator's work station.

Use of railway cars on a railway enables heavy loads to be moved on a predefined path with a minimumly powered drive mechanism. The use of an electric drive motor allows operation of the system to be electronically controlled from a electrical control panel located at the convenience of the work station operator. This allows material supply to be managed by the work station operator without leaving his work station and eliminates the necessity of a separate operator for the supply train.

The supply train is in most instances carried on a linear track for back and forth travel on the track for positioning a select car at the work station or feed station for unloading. While the supply train has many different uses, the demands of the particular application as a stock supply train to a saw mill details the versatility of the system.

These and other features will become apparent from considering the detailed description of the preferred embodiments of this specification.

BRIEF DESCRIPTION OF THE DRAWINGS

FIG. 1 is a side elevational view of the stock supply train with two cars.

FIG. 2 is a end view of the stock supply train and an operator's control panel.

FIG. 3 is an enlarged perspective view partially fragmented of the coupling assembly for joining the two cars of the stock supply train of FIG. 1.

FIG. 5 is a perspective view of the chain tension assembly at the end of one of the cars in FIG. 1.

DETAILED DESCRIPTION OF THE PREFERRED EMBODIMENTS

Figure 4:
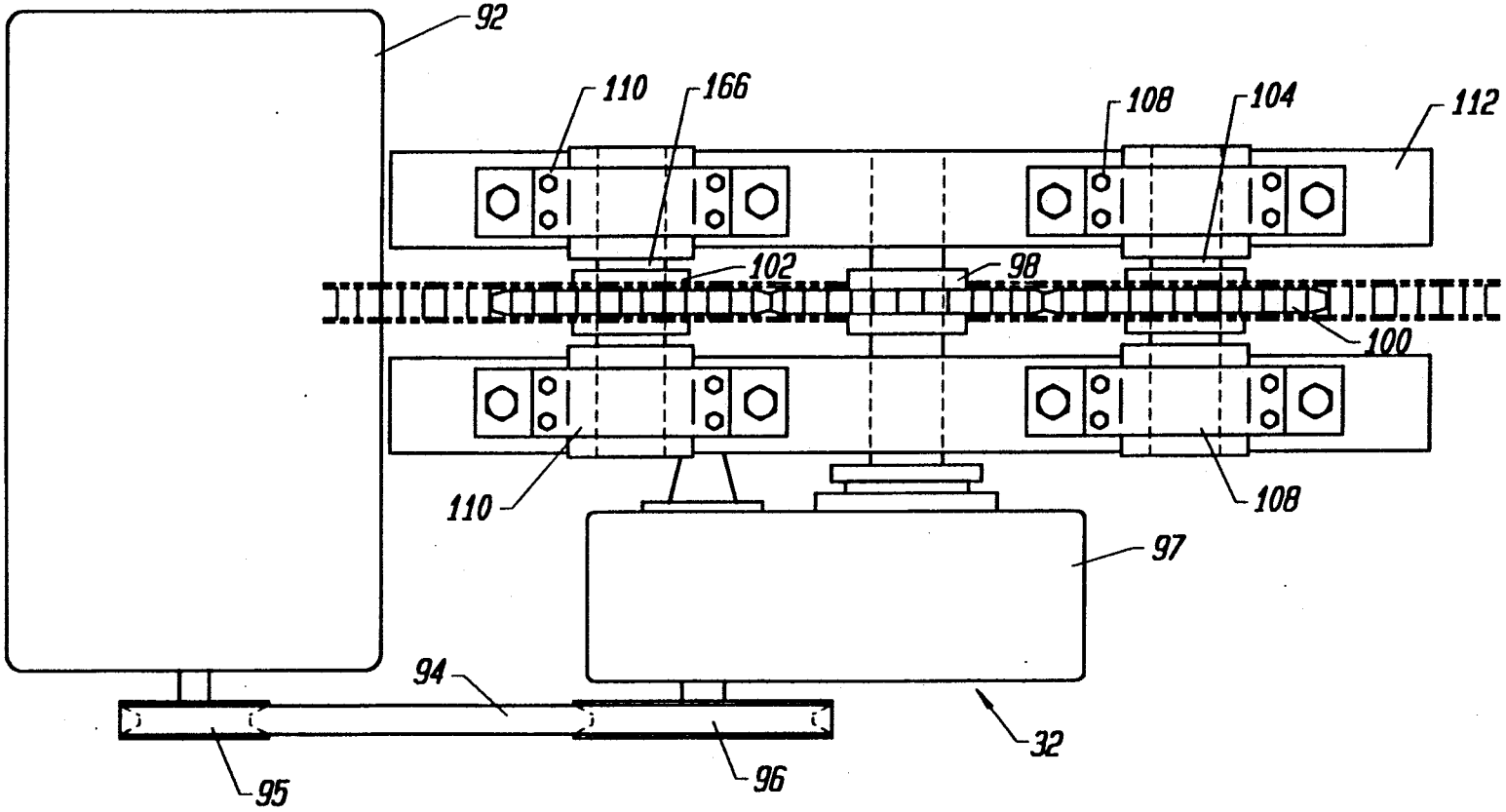
FIG. 4 is an enlarged top view of the drive mechanism (without chain) for propelling the stock supply train.

The stock supply train is shown in FIGS. 1 and 2 and designated generally by the reference numeral 10. The supply train 10 is shown with two rail cars 12 riding on a railway 14. It is understood that the supply train can include additional cars, usually 5 or 6 cars, depending on the requirements of the application. The rail cars 12 have a flat-bed style carriage 16 with vertical wheel struts 18 which support flanged railway wheels 20 positioned on spaced tracks 22 of a railway 24. The railway 24 has a series of spaced ties 26 which support the steel rails 28 which form the tracks 22. The rails are standard 30 pound mining rails on 4×4 ties. The rails 28 are fastened to the ties by bolt and bracket assemblies 30, for convenient disassembly, if desired. Where the ground surface is stable, the ties can be directly seated on the ground surface without other bedding or attachment. For most operations, a narrow gauge system is adequate for reciprocal, linear transport of four thousand board feet of lumber stock, per car over a relatively flat transport path. Surface dips and moderate inclines do not affect operation.

Positioned between the spaced tracks 22, midway on the railway 24 is a drive mechanism 32. The drive mechanism 32 has a support bed 34 that rests on the ties 26 and abuts the base of the rails 28 for stability. A sprocket assembly 36 engages an elongated length of link chain 40 which is connected to a spring assembly 39 on an end plate 41 on one end car **12*a* and to a similar spring assembly 42 on an end plate 43 on the opposite end car 12***b*. The spring assembly 42, for example, has an adjustment means allowing the link chain 40, which runs the length of the supply train, to be tensioned. In addition to providing smooth operation of the supply train, the tension of the chain maintains the coupling of the cars 12, as discussed in greater detail hereafter.

The cars 12 are simply constructed with a pair of elongated, steel-tube, side beams 44 interconnected by spaced cross supports 46. The cross supports need not be uniformly spaced, and except for the end members 48, can be located according to need, as exemplified for the different lengths of lumber 50, 52 and 54 carried by the supply train shown in FIG. 1. For short lengths of lumber, wood 4×4's can be added as temporary cross supports.

The load supporting cross supports 46 are cantilevered out over the side beams 44 to increase carrying capacity, and have stake pockets 56 at their distal ends for insertion of stakes 58 as shown in FIG. 2. Because of the overall stability of the system, the stakes are generally not needed. The stakes are customarily used on the side away from the work station operator in milling to allow access and removal of lumber from the lumber stack, while preventing a partially depleted stock from toppling backward.

The cross supports 46 are welded to the side beams 44 and reinforced by gussets 60 as shown in FIG. 2. The railway wheels 20 are mounted on an axel 62 in the yoke-configured struts 16 which are welded to the side beams 44. The carriage 16 of the cars 12 clears the stationary drive mechanism 32 located on the support bed 34 between the rails 28 as shown in FIG. 2. Wheel guards 64 clear the track from debris, such as end cuts from milling.

When a plurality of cars are used, the facing ends 66 and 68 of the side beams 44 abut, as shown in FIG. 3. To insure that the abutting ends do not become dislocated, a coupling assembly 70, as shown in FIG. 3, is provided. The assembly 70 includes a plate member 72 on one end 68 and a bracket member 74 on the other end 66 with a pair of ribs 76 on the bracket member 74 forming a slot 78, and, a single rib 80 on the plate member 72 forming a key 82. The coupling assembly thereby restricts vertical displacement by the bracket 74 and plate 72 and lateral movement by the slot 78 and key 82. Tension is imparted to the link chain 40 by the spring assembly 42 shown in FIGS. 1 and 5. The spring assembly 42 has a large compression spring 84 sandwiched between the end plate 43 of the carriage 16 and an end plate 86 of the spring assembly 42. A threaded rod 88 is connected at one end to the chain 40 and passes through holes in the end plates 43 and 86, where the threaded end of the rod 88 is engaged by a tensioning nut 90, which when tightened, compresses the spring 84. Spring assembly 39 is constructed in the same manner.

The drive mechanism 32, includes a reversible drive motor 92 with a drive belt 94 connected to the drive pulley 95 of the motor and to the driven pulley 96 of a reduction gear box 97, as shown in FIG. 1, and in greater detail, in FIG. 4. The gear box 97 has a drive sprocket 98 around which the link chain 40 is wrapped. A pair of idler sprockets 100 and 102 mounted on journals 104 and 106 are supported by pillow blocks 108 and 110 on a support frame 112.

The drive mechanism 32 also includes a control panel 114 electrically connected to the drive motor 92 by an electric cable 116 and to a power source (not shown) for activating the drive motor. The control panel 114 has at least an on/off switch 117, a forward switch 118, a reverse switch 120 and a horn 122 which is activated during movement. The forward and reverse switches 116 and 120 are preferably activated to move the train forward or backward on the track only when the operator continues pressing the switch. Automatic shut-off switches 124 are tripped by the train approaching the end of the track to stop further movement of the train.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A stock supply train system for delivery of materials to a work station, the supply train system comprising:

a railway train and a railway having a predefined path for back and forth movement of the railway train on the railway, the railway having a length of railway track including a pair of spaced, parallel rails forming the track on which the railway train rolls, wherein the railway train includes opposite, first and second ends with a flat-bed carriage supported on railway wheels on each rail of the railway track, and at least one railway car, a stationary chain drive located on a support bed between the rails, the chain drive having a drive mechanism and a feed chain that engages the drive mechanism at the chain drive, the feed chain extending in opposite directions from the chain drive under the railway car carriage of each car with ends directly connected to the opposite, first and second ends of the railway train without intermediate idler rollers, the feed chain engaging the drive mechanism of chain drive between the ends, wherein the feed chain is suspended between the drive mechanism and the ends of the railway train, and wherein the chain drive is positioned midway on the predefined path and has control means for selectively operating the chain drive in a forward and reverse direction for reciprocal displacement of the railway train on the track, wherein the train is selectively positionable at the stationary chain drive at any positioned between the ends of the train.

2. The train system of claim 1 wherein the train includes a plurality of cars with opposite end cars having outside ends comprising the opposite, first and second ends of the railway train, and wherein the feed chain is positioned between the rails and is connected to the outside ends of the end cars.

3. The train system of claim 2 wherein the end cars have chain connection means for connecting the end cars to the opposite ends of the feed chain.

4. The train system of claim 3 wherein the chain connection means includes tension means for imparting a tension to the chain.

5. The train system of claim 4 wherein the tension means includes a spring assembly mounted on the outside end of at least one of the opposite end cars, with the chain having one end connected to the spring assembly, having a spring engaged with the chain such that the chain is maintained in tension.

6. The train system of claim 2 having coupling means for coupling adjacent cars.

7. The train system of claim 6 wherein the coupling means comprises a coupling assembly having complimentary abutting contact surfaces on opposed ends of adjacent cars, the coupling means comprising further, chain connection means for connecting the end cars to the opposite ends of the feed chain, wherein the chain connection means includes tension means for imparting a tension to the feed chain.

8. The train system of claim 1 wherein the chain drive has a drive motor with a drive pulley and has a gear box with a driven pulley and with a sprocket assembly, the drive motor having a drive belt connecting the drive pulley of drive motor with the driven pulley of the gear box, wherein the feed chain engages the sprocket assembly of the gear box.

9. The train system of claim 8 wherein the drive motor has a forward and reverse drive and the control means includes a stationary control panel with operator controls and electric circuitry connecting the operator controls with the drive motor for operating the drive motor in a forward or reverse direction under control of an operator.

10. The train system of claim 9 wherein the control panel is located at the work station wherein an operator at the work station has convenient access to the control panel.

11. The train system of claim 1 wherein each car has the carriage constructed with a pair of elongated parallel support beams and a plurality of cross beams interconnecting the support beams, with four spaced strut assemblies mounted to the support beams, the strut assemblies having the wheels mounted to the struts and engaging the tracks, wherein the carriage is constructed to clear the stationary drive mechanism.

* * * * *